US005981919A

United States Patent [19]

Masten, Jr.

[11] Patent Number: 5,981,919

[45] Date of Patent: Nov. 9, 1999

[54] METHOD AND APPARATUS FOR CHARACTERIZING AND CONTROLLING THE HEAT TREATMENT OF A METAL ALLOY

[75] Inventor: James W. Masten, Jr., Seattle, Wash.

[73] Assignee: Bouillon, Inc., Seattle, Wash.

[21] Appl. No.: 08/798,902

[22] Filed: Feb. 11, 1997

[51] Int. Cl.[6] ..... H05B 1/02

[52] U.S. Cl. ..... 219/502; 219/483; 219/497; 148/511; 148/DIG. 80; 148/698

[58] Field of Search ..... 219/483–486, 219/497, 499, 501, 505; 148/511, 508, 498, 700, DIG. 80, 698, 549, 128

[56] References Cited

U.S. PATENT DOCUMENTS

| | | | |
|---|---|---|---|
| 3,496,033 | 2/1970 | Gilbreath, Jr. et al. . | |
| 5,094,702 | 3/1992 | Kothmann et al. | 148/128 |
| 5,306,359 | 4/1994 | Eppeland et al. . | |
| 5,336,341 | 8/1994 | Maejima et al. . | |
| 5,336,344 | 8/1994 | Wei . | |
| 5,340,418 | 8/1994 | Wei . | |
| 5,485,985 | 1/1996 | Eppeland et al. . | |
| 5,656,106 | 8/1997 | Amateau et al. | 148/586 |
| 5,730,198 | 3/1998 | Sircar | 164/4.1 |

OTHER PUBLICATIONS

"Advanced Technology Program Proposal Cover Sheet," *U.S. Dept. of Commerce*, May 1995.

*Primary Examiner*—Mark Paschall
*Attorney, Agent, or Firm*—Robert M. Storwick

[57] ABSTRACT

A method and apparatus for characterizing and controlling the heat treatment of a metal alloy employing non-contact sensors selectively positioned to minimize the effects of background temperature contributions. The sensors monitor the temperature of the part being treated at a location that is remote from the surface that is being irradiated directly. In preferred embodiments, the surface where the temperature measurements are taken are located within a black body source. The collected temperature information is used to control the heat treatment of the metal alloy.

3 Claims, 7 Drawing Sheets

METHOD AND APPARATUS FOR CHARACTERIZING AND CONTROLLING THE HEAT TREATMENT OF A METAL ALLOY

FIELD OF THE INVENTION

The present invention relates to a method and an apparatus for the heat treatment of a metal alloy, such as an aluminum alloy, using infrared emitters as the energy source. The method provides for the characterization and control of a heat treatment process and also relates to an apparatus for carrying out such methods.

BACKGROUND OF THE INVENTION

Cast aluminum is a single phase material in which other elements that are added to the aluminum phase are in solution or dissolved in the aluminum. When aluminum is allowed to slowly cool from a melt phase, e.g., standing in open air, the added elements in the aluminum precipitate out of the solution through a process known as nucleation. Nucleation in material allowed to slowly cool is a process in which not many nuclei are formed, but the ones that do form grow rapidly in size and consume the added elements. This results in a bulk article wherein the aluminum is a relatively pure metal with small volumes of added elements distributed throughout the aluminum. This state is undesirable when the aluminum is being used to form structural articles because pure aluminum is soft and weak.

If aluminum with added elements is rapidly cooled (quenched) while still hot and in a solutionized state, the added elements do not have the opportunity to form large nuclei, but will form many more smaller nuclei as the metals solidify. If the aluminum and added elements have been allowed to slowly cool to a solid, it is still possible to add enough thermal energy to force the added elements to dissolve in the aluminum (solutionize) without actually melting the aluminum. The advantage this offers is that aluminum can be cast into shape, cooled in air until some time later, and then resolutionized and quenched. The thorough distribution of many nuclei, distributed uniformly, dramatically increases the strength of the alloy over pure aluminum or alloys that cool too slowly and form fewer, but large nuclei.

The aluminum alloy can be developed to further improve its mechanical strengths by growing the size of many uniformly distributed nuclei through a process called "aging." During "aging," the nuclei grow as a diffusion process that progresses more rapidly at elevated temperatures. But, if the temperatures are elevated too extensively, the nuclei will collapse together and form fewer large nuclei similar to that found in aluminum that has been slowly cooled, e.g., without solutionizing, as described above.

The aluminum casting industry uses heat treating as a mechanism to increase the strength of the aluminum castings. The process usually amounts to the addition of sufficient thermal energy to force all of the elements that have been added to the aluminum into solution (solutionizing). Energy is consumed as these added elements are dissolved into the aluminum solid phase. The amount of energy required to achieve the necessary diffusion is significant.

Conventional methods for producing cast aluminum alloy products include initially pouring a suitable molten aluminum alloy into a mold. After the molten alloy has completely solidified, the casting is removed, and is set aside to cool in the open air. Normally, a few days worth of production is collected for a batch solutionizing process. Alternatively, the removed casting can be immediately subjected to a solution heat treatment without cooling first.

A conventional method for solution heat treating a cast part involves placing many cast parts in a large forced air convection oven. In the convection oven, the castings are heated to a desired "solution" temperature (approximately 1,000° F.) and maintained at this temperature for at least 2–8 hours. Following the solution heat treatment, the cast part is immediately quenched in water to rapidly cool the product. Following this cooling, the part is naturally or artificially aged.

One of the drawbacks of conventional solution heat treatment processes, such as that described above is the length of time required to complete the treatment. Typically, large numbers of cast aluminum parts are solution heat treated at once in a batch process. Since it is difficult to maintain even and uniform temperatures in all the parts, in order to ensure that all the parts are properly heat treated, the length of the solution heat treatment process is usually at least two hours and often times more than eight hours. The length of time required for the solution heat treatment contributes significantly to the speed with which cast parts can be manufactured and also contributes significantly to the overall energy costs associated with the solution heat treatment process.

It has been proposed that infrared heat treatment systems may improve the operational efficiency of conventional air driven solution heat treating processes by reducing cycle times. For example, U.S. Pat. No. 5,306,359 describes a method for heat treating an aluminum part by applying infrared radiation directly from a source of infrared energy to the part until the part attains a desired state of heat treatment. According to the '359 patent, during the heat treating, the temperature of the part is monitored and the intensity of the radiation source is proportionally controlled in response to the monitored temperature. The temperature of the part in the '359 patent is described as being monitored by a plurality of optical pyrometers 80, 82 and 89, illustrated as being directed toward an irradiated surface of the part.

The '359 patent describes that the use of optical pyrometers to measure the temperature of the aluminum cast parts is complicated by the reflectivity of aluminum and the uncontrolled radiant energy from the background (i.e., the temperature of the lamps, and refractive surfaces). Reportedly, the reflectivity of the aluminum and the radiant energy of the background cooperate to create a temperature readout from the optical pyrometers that is not representative of the temperature of the surface of the part being observed by the optical pyrometers. In an effort to account for these inaccuracies and provide a more accurate reading of the temperature of the part, the '359 patent describes the taking of measurements from a background optical pyrometer, and making adjustments to the readout from the part optical pyrometer based on the readout from the background optical pyrometer.

U.S. Pat. No. 5,336,344 describes a method and apparatus for producing a cast aluminum part using a high intensity electric infrared heating system to heat the part. The described system is similar to the system described in U.S. Pat. No. 5,306,359 noted above. The '344 patent broadly describes that each infrared heating station includes means for monitoring the actual temperature of the wheel, and that the heating of the wheel at each station is controlled in accordance with this monitored temperature. Like the '359 patent, the '344 patent describes that optical pyrometers 46 can be used to generate a signal representative of the wheel temperature. The '344 patent describes that this signal can be used to control the heating of the parts. In the illustrations, the optical pyrometers are shown as being directed at a surface of the part that is irradiated.

U.S. Pat. No. 5,340,418 by the same inventor of the '344 patent proposes additional control methods to control the amount and application rate of infrared energy applied to the part during the solution heat treating process. These proposed methods rely upon the same optical pyrometers described in the '344 patent for assessing the part temperature. In one embodiment, the optical pyrometers are used to monitor the temperature of the part. This temperature is compared to a predetermined solution heat treatment temperature which is chosen as a function of the particular material used to cast the part. As long as the temperature of the wheel as measured is less than the predetermined solution heat treatment temperature, the heating is continued at the initial predetermined level provided by the infrared energy source.

In each of the processes described in the three patents noted above, the cast aluminum part is indexed through a plurality of individual stations while the part is rotated relative to the path of travel. By indexing the part through the stations, the part resides in each station for a predetermined period of time before it is transported to the next station.

Industry expectations for each of the processes and apparatuses described in the patents noted above was high; however, practical experience has shown that the processes and apparatuses described in the above patents have not found commercial acceptance due to difficulties in producing cast aluminum parts with reliable physical properties, such as strength. Accordingly, there continues to be a need for improvements to processes for solution heat treating cast metal alloy parts using infrared energy as a heat source.

SUMMARY OF THE INVENTION

Prior attempts to control the heat treatment of aluminum alloy wheel hubs by relying upon temperature measurements taken at a location other than a surface remote from the surface being irradiated required that adjustments or corrections be made in the generated signals in an attempt to obtain a signal truly reflective of the temperature at the measured surface.

These adjustments or corrections were necessary because in practice, when temperature measurements were taken, for instance from a surface that was irradiated, reflection from the highly reflective aluminum part and background temperature signals coming from the sources of infrared radiation as well as refractive structures within the oven interfered with the ability of the optical thermocouples to produce an accurate indication of the true temperature of the wheel hub at the measured surface. In addition, prior attempts to control the heat treatment of aluminum alloy wheel hubs by relying upon a temperature measurement at a location other than a surface remote from the surface being irradiated, e.g., from a surface being irradiated, were based upon the assumption that when the temperature of the measured surface reached a certain level and was held at this level for a predetermined period of time, the balance of the wheel hub was also heated to a certain minimum temperature necessary to effectively heat treat the hub. Unfortunately, these prior attempts failed to realize that such assumption was not necessarily true due to variances in the composition of the wheel hub or other factors that would affect the heat transfer away from the surface being irradiated and thus the heating of the balance of the hub. In other words, by relying only upon the temperature measurement taken from a surface being irradiated, one could not obtain an accurate indication as to the temperature that the entire wheel hub had been heated to. Applicant's present invention provides for the direct measurement of a temperature of the wheel hub at a surface that provides a more accurate representation of the minimum temperature to which the entire wheel hub has been heated. In accordance with the present invention, these measurements are taken in a manner that makes it unnecessary to adjust the generated signals in order to account for contributions made by background temperature sources such as the infrared energy sources, refractive structures, or reflection from the wheel hub itself. In a preferred embodiment, the present invention also allows for the direct measurement of the temperature of the wheel hub in a manner that minimizes the effect of variations in the emissivity of the wheel hub itself.

One embodiment of the apparatus for the heat treatment of a metal alloy part using infrared radiation as a heat source formed in accordance with the present invention comprises a plurality of infrared radiation sources for heat treating a part with infrared radiation. The plurality of radiation sources partially defines a channel through which a part is passed using a part handling system. In a preferred embodiment, the part handling system transports the part through the channel without stopping, i.e., a truly continuous sequence. A noncontact sensor adjacent to the channel is positioned to collect data representative of an actual temperature of the part at a location remote from the surface that is irradiated. In a preferred embodiment, the noncontact sensor is positioned so as not to receive energy directly from the source of infrared radiation or reflected energy from the part or surrounding environment which would introduce inaccuracies into the temperature reading. By selectively positioning the noncontact sensor in accordance with the present invention, applicant is able to record a more accurate temperature of the part compared to temperature readings obtained from sensors that are not isolated from background temperature contributions. Such background temperature contributions originate from many sources such as the infrared energy sources themselves and reflected energy. The noncontact sensor is preferably coupled to a computer capable of recording the temperature and time data, i.e., the thermal gradient profile. This profile is then compared to a predetermined thermal gradient profile by a control system. Adjustments can be made to the amount of thermal energy applied to the part based upon the results of the comparison between the collected thermal gradient data and the predetermined thermal gradient profile.

Optimally, the computer includes software capable of recognizing and categorizing the thermal gradient profile information. This information is used by the computer to forecast and control the amount of thermal energy to be applied to the part. For example, the computer predicts the energy to be applied in the next measured unit of time based on the thermal gradient of the previous unit of time with its known temperature increase and amount of applied energy.

In accordance with another aspect of the present invention, a method for generating a thermal gradient profile for the heat treatment of a metal alloy part is provided. One embodiment of a method of generating a thermal gradient profile for the heat treatment of a metal alloy using infrared radiation as an energy source includes the step of first providing a test part of the metal alloy. Thermal energy in the form of infrared radiation is applied to a surface of the test part. Data is collected that is representative of a temperature of the test part as a function of time at a location remote from the surface that is irradiated. After the irradiating step is complete, mechanical properties for the test part are determined.

The collected temperature and time data provide a thermal gradient profile. Depending upon the mechanical properties for the treated part this profile can be accepted and relied upon to control subsequent treatments, or it can be rejected. If the thermal gradient profile is rejected, the process can be repeated and the heating profile changed in an effort to develop an acceptable thermal gradient profile. The accepted thermal gradient profile can then be used to control the heat treatment of additional parts that are similar in shape and composition to the original part used to generate the thermal gradient profile.

Another aspect of the present invention relates to a method of controlling a heat treatment process for a metal alloy. One embodiment of a method for controlling the heat treatment of a metal alloy using infrared radiation as an energy source involves the step of first providing a part of the metal alloy. Thermal energy in the form of infrared radiation is applied to a surface of the part. Data representative of a temperature of the part at a location remote from the surface that is irradiated is collected, preferably as a function of time. This temperature and time data provide a thermal gradient profile, which may be transformed into a rate profile by taking the first derivative of the data. The amount of thermal energy applied to the part is then adjusted in response to a comparison between the thermal gradient profile being monitored and a predetermined thermal gradient profile, optionally generated in accordance with the aspect of the present invention described above.

An important aspect of applicant's present invention relates to the monitoring of the temperature of the part at a location remote from the surface that is irradiated. Several advantages are achieved by monitoring the temperature of the part in accordance with this aspect of the present invention. These include avoiding background temperature contributions from the sources of infrared radiation as well as from reflection of energy from the refractive structures. Preferably, the location where the temperature is monitored in accordance with the present invention defines an endpoint of a longest average thermal path for the part. By choosing an endpoint of a longest average thermal path for the part as the location where the temperature can be monitored, one can more reliably expect that the entire part has been exposed to the particular temperatures that are measured by the sensor, thus providing a more reliable indication of the heat treatment of the entire part. By more reliably predicting the temperature that an entire part has been heated to, applicant is better able to control the heat treatment process so that the number of off specification parts is minimized. In addition, since the user is more confident that the entire part has been heated to a minimum temperature, it is not necessary that the part be held at the heat treatment temperature for unnecessarily long periods of time in order to ensure that the part is properly heat treated.

In a preferred embodiment of the present invention, the temperature of the part is measured at a location within a black body source defined within the body of the part. Measuring the temperature within a black body source is preferred because it eliminates any reflective component, while it minimizes the effect that variances in the emissivity from one part to another may have on the temperature reading. Since the emissivity of a given part will affect the measurement of the temperature of that part, particularly when a non-contact, infrared optical sensor is used, it is preferred to negate any inaccuracies introduced into the measurement of the temperature as a result of variances in the emissivity from part to part.

Applicant's invention provides an apparatus and methods for using non-contact optical sensor and infrared radiation as the source of thermal energy for the heat treatment of metal alloy parts that overcome the drawbacks that were inherent previously proposed systems for using optical sensors and infrared radiation as a thermal energy source for heat treatment of metal alloy parts.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The following detailed description of a preferred embodiment of the present invention proceeds with reference to the heat treatment of an aluminum alloy 356 cast into a wheel hub. It should be understood that the scope of the present invention is not limited to aluminum alloy 356 or to wheel hubs. The present invention is equally applicable to the heat treatment of other metal alloys such as aluminum 357, aluminum 319, and several of magnesium that are cast into shapes other than wheel hubs, although it is preferred that the cast parts be substantially symmetrical in shape.

Suitable aluminum casting material, such as A356 aluminum, can be used to cast wheel hubs using conventional casting techniques such as gravity casting, low pressure, squeeze, semisolid and die casting. A356 aluminum alloy generally includes approximately 6.0–7.5 weight percent silicon, 0.25–0.45 weight percent magnesium, about 0.2 weight percent iron, about 0.2 weight percent titanium, 0.008–0.04 weight percent strontium, and the balance aluminum. It should be understood that the aluminum component of the A356 alloy can include residual amounts of other elements that may be present in the alloy material, such as manganese, copper, calcium, zinc, barium, carbon, zirconium, and sodium. Other suitable casting alloys include A333 or A357 aluminum, or magnesium.

The following description of the present invention is in the context of a preferred embodiment comprising solution heat treatment. The following description is not intended to be limited to solution heat treatment, and is applicable to other heat treatments, such as artificial aging.

Figure 3:
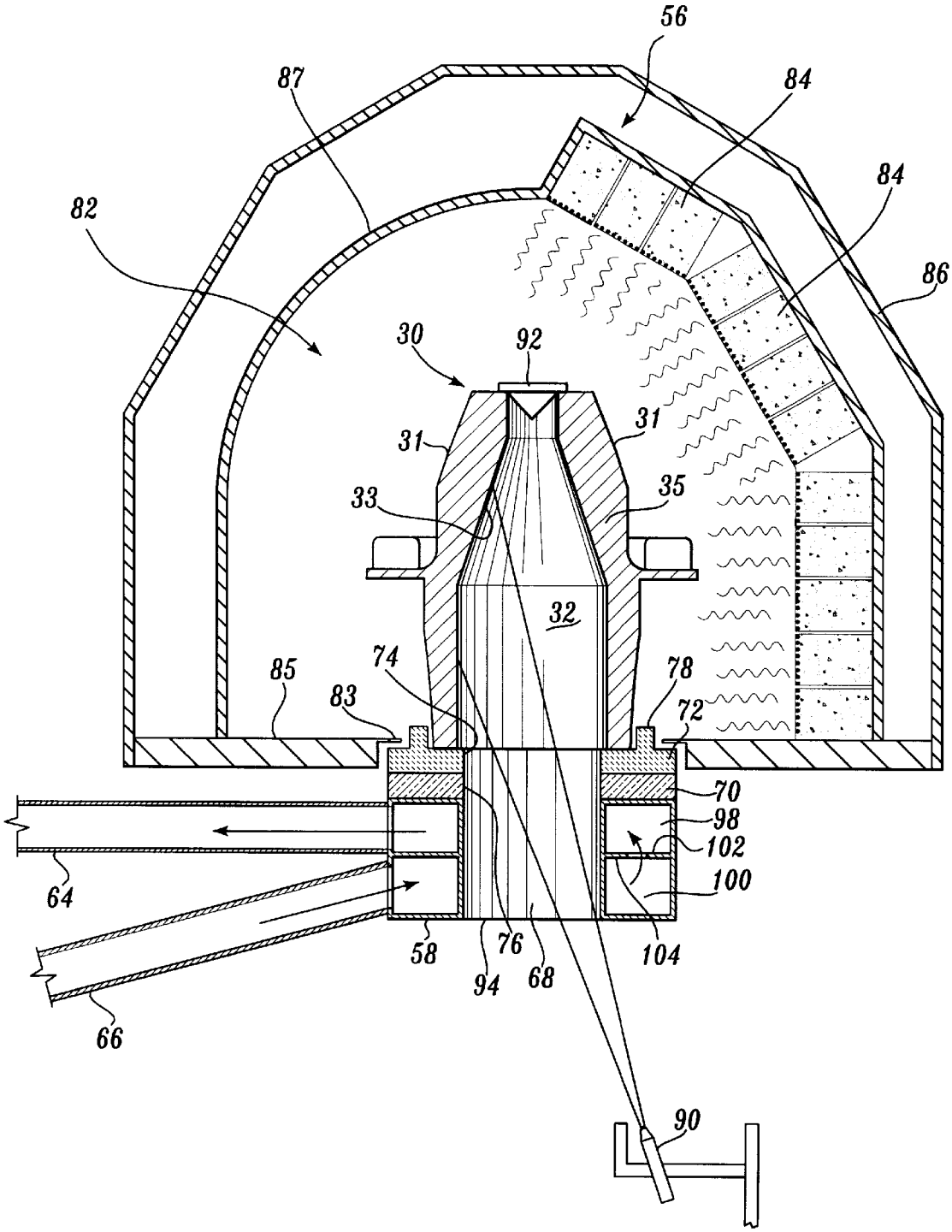
FIG. 3 is a view taken along line 3—3 in FIG. 1.

Referring to FIG. 3, a conventional cast aluminum alloy wheel hub 30 is symmetrical and includes centrally located internal cavity 32 that extends from the top to the bottom of wheel hub 30, thus defining a bore through the wheel hub. For the purpose of the following description, wheel hub 30 has an outer surface 31 which defines the exterior of wheel hub 30 and an inner surface 33 that defines the internal cavity. Outer surface 31 and inner surface 33 are separated by the body 35 of wheel hub 30. As described below in more detail, outer surface 31 is the surface that receives radiant energy directly from the infrared energy sources described below in more detail. As described in the Background, prior art processes have measured the temperature at this surface and used the information to attempt to control a solution heat treatment process. In the illustrated embodiment, internal cavity 32 is open at the top and bottom of wheel hub 30. In accordance with a preferred embodiment of the present invention, a black body source is defined within wheel hub 30 by closing off the open top end of wheel hub 30 with cap 92 capable of blocking energy in the infrared and visible spectrum and preventing it from entering internal cavity 32 through the top of hub 30. The opening in the bottom of hub 30 remains open so that internal cavity 32 can be accessed and measurements taken to ascertain the temperature of the wheel hub at surface 33.

Figure 1:
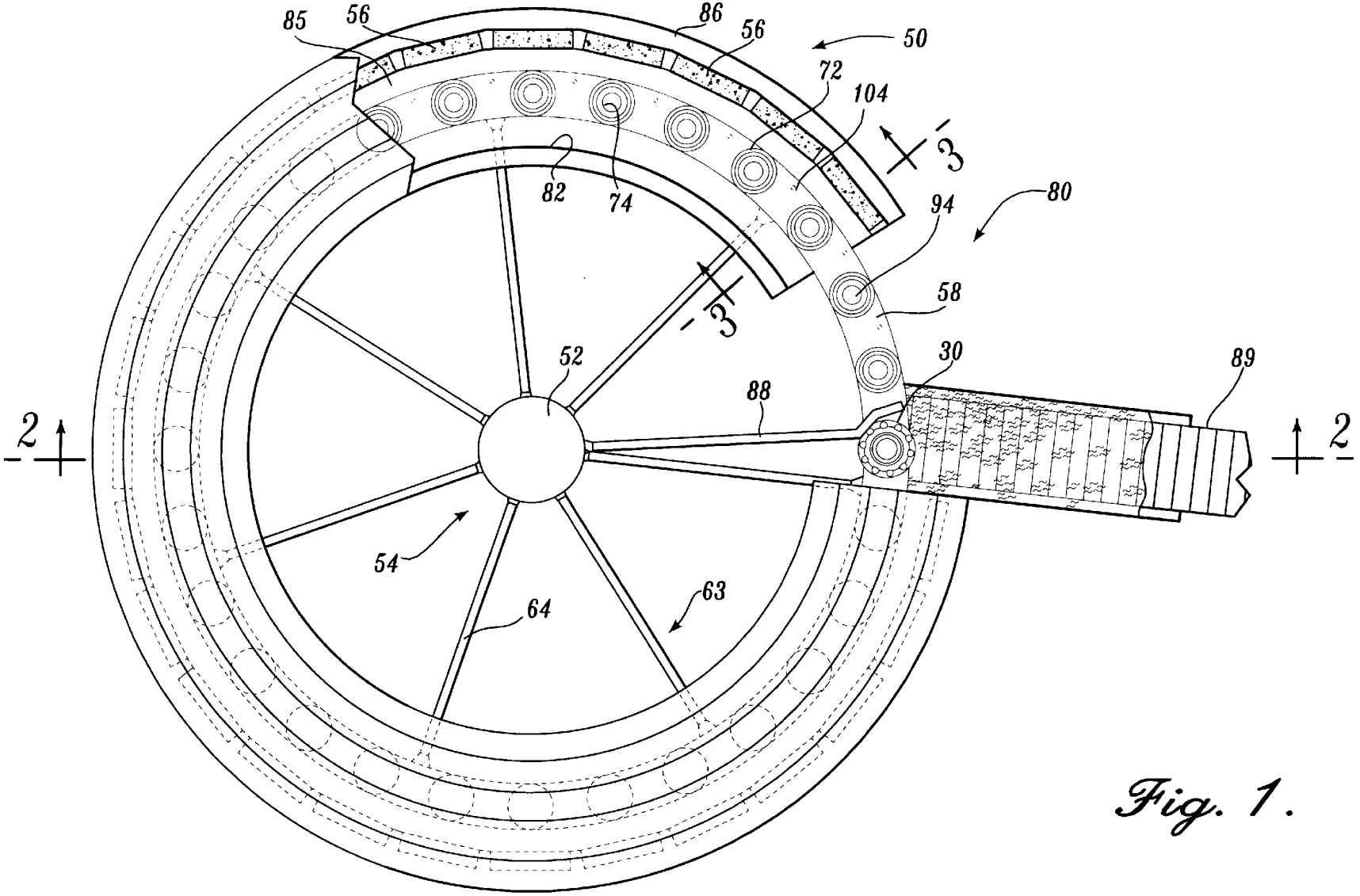
FIG. 1 is a top plan view with a portion cutaway of an apparatus for heat treating a metal alloy part formed in accordance with the present invention.
Figure 2:
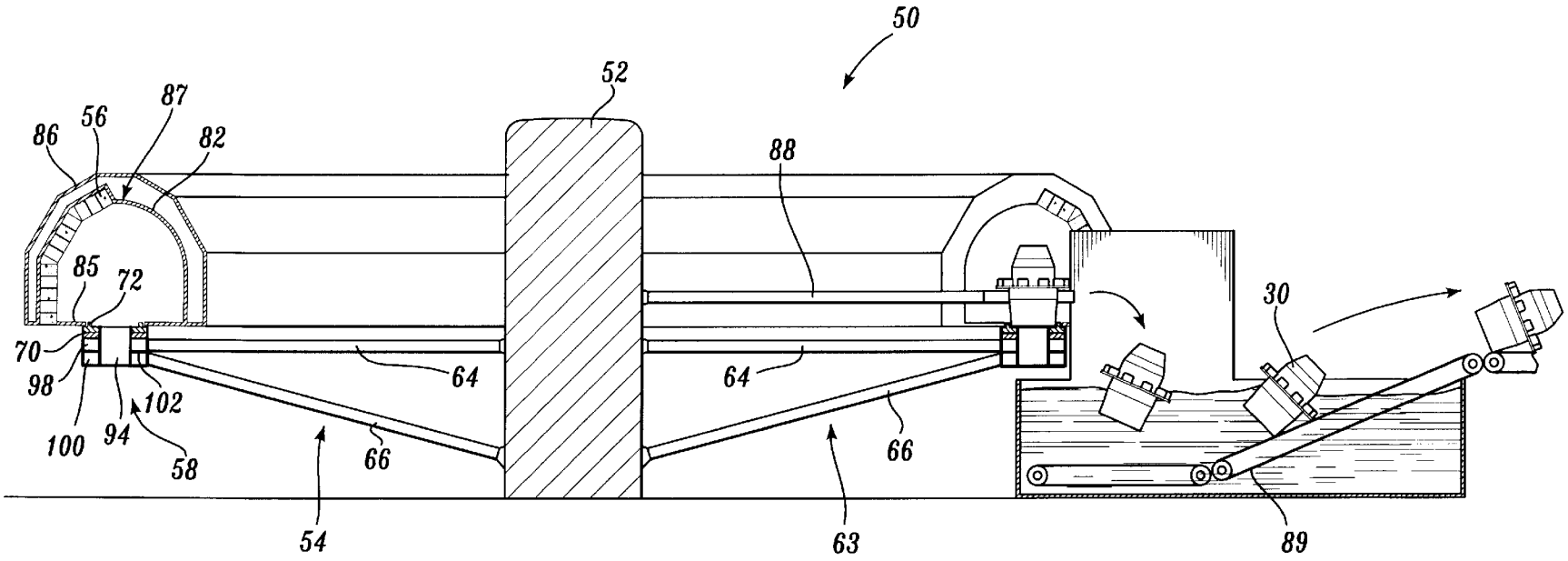
FIG. 2 is a view taken along line 2—2 in FIG. 1.

Referring additionally to FIGS. 1 and 2, one embodiment of an apparatus for heat treating a metal alloy part formed in accordance with the present invention includes rotary oven 50 arranged in a circular configuration to carry a plurality of aluminum wheel hubs 30 or other cast parts past a plurality of infrared radiation sources 56. While the present embodiment of an apparatus for heat treating metal alloy parts is described and illustrated as a rotary oven, the present invention is not limited to rotary ovens. Other geometric configurations of an oven will fall within the scope of the present invention. For example, a linear oven or an oven arranged in a noncircular configuration are also examples of ovens useful in accordance with the present invention.

Rotary oven 50 includes two major components, a heating channel 82 that houses a plurality of infrared radiation sources and a transportation system 54 for transporting wheel hubs through heating channel 82. The following description will proceed first with respect to the transportation system, followed by a discussion of the heating channel.

Figure 4:
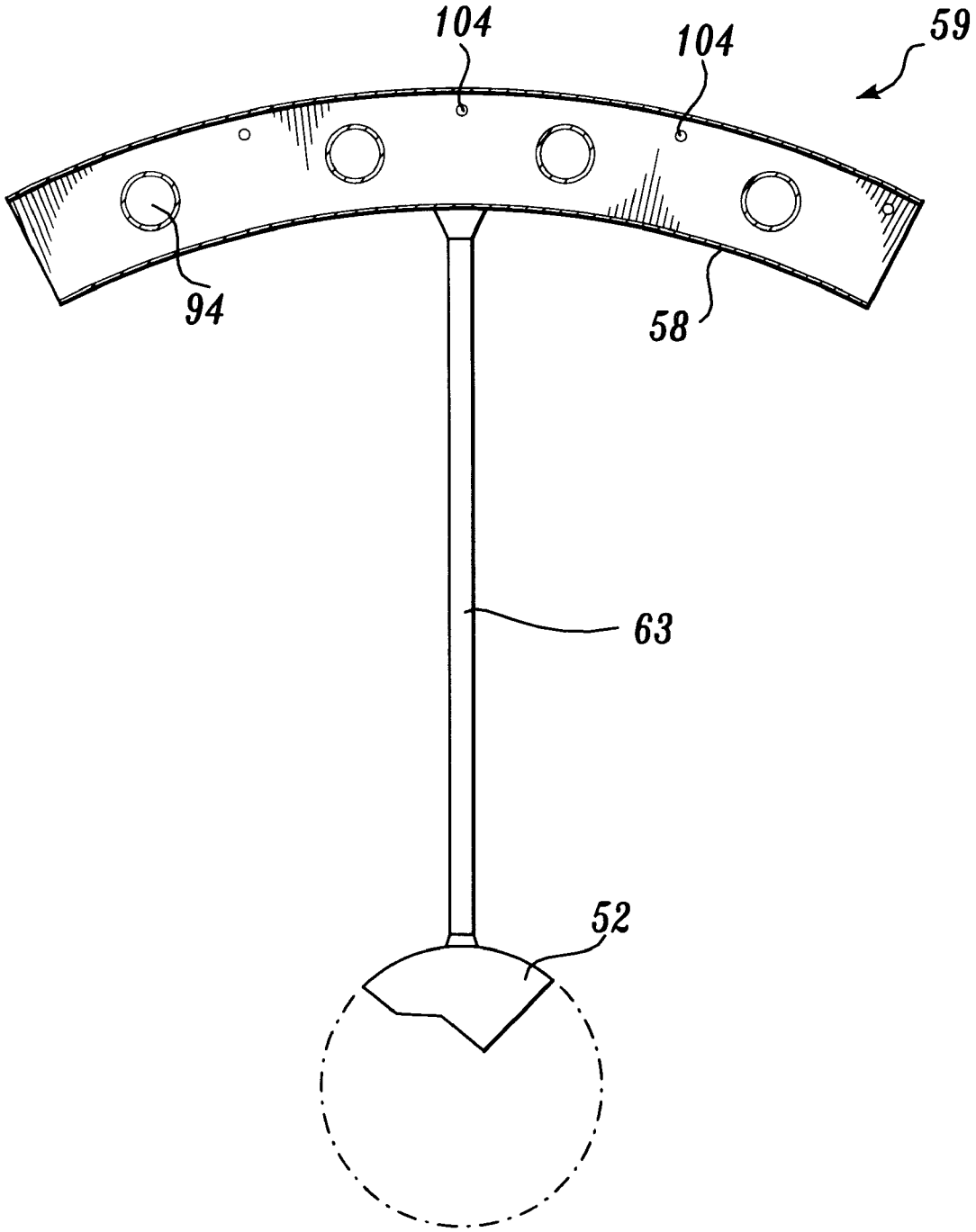
FIG. 4 is a top plan view of a segment of the apparatus of FIG. 1 with the channel and cast aluminum parts removed.

Referring additionally to FIG. 4, rotary oven 50 includes a transportation system 54 that includes a circular support carriage 58, central hub assembly 52, and truss assembly 63 that cooperate to transport wheel hubs 30 along a pathway through oven 50. In the illustrated embodiment, support carriage 58 is comprised of a plurality of sections 59 as shown in FIG. 4. Each section 59 defines a one-seventh portion of the illustrated carriage 58. Support carriage 58 is in the shape of an annular ring having an average diameter that is substantially the same as the diameter of channel 82. Support carriage 58 is wide enough so that it can support wheel hubs 30 on an upper surface dimensioned to carry parts to be heat treated in accordance with the present invention. The lower surface of support carriage 58 is spaced from the upper surface. Vertical walls extending between the inner and outer edges of the upper and lower surface serve to partially define a conduit for carrying cooling water as described below in more detail. The ends of these conduits are closed by vertical walls that extend between the upper and lower surface of support carriage 58 at the opposite ends. While support carriage 58 has been described as a modular unit, other constructions, such as one piece construction or a construction with more sections are considered to be within the scope of the present invention. Support carriage 58, in a preferred embodiment, comprises multiple sections, each section comprising four seats or locations for receiving wheel hubs 30. Each of these locations is defined by a bore 94 that extends through support carriage 58 from its upper surface to its lower surface. Support carriage 58 is hollow and is divided into an upper section 98 and a lower section 100 by horizontal plate 102. Plate 102 extends along the length of each section 59 of support carriage 58. Bore 94 also passes through plate 102. Plate 102 at its outermost edge includes a plurality of spaced-apart openings 104 allowing upper section 98 to be in fluid communication with lower section 100. This enables cooling fluid to pass between the upper and lower sections in order to remove heat from support carriage 58. Support carriage 58 can be machined from rigid strong materials such as steel. Each of the adjacent sections 59 can be connected in a conventional manner, such as welding or fasteners in order to form the circular support carriage 58.

A central hub assembly 52 of a conventional design serves as the axle for transportation system 54 that carries wheel hubs 30 through oven 50.

Support carriage 58 is supported for rotation around central hub assembly 52 by a plurality of truss assemblies 63 that extend radially from an upper rotating coupling (not shown) mounted on central hub assembly 52 and a lower rotating coupling (not shown) mounted below the upper rotating coupling. Upper rotating coupling and lower rotating coupling rotate around central hub assembly 52 in a conventional manner. Conventional means, such as an electric motor, are provided to drive the rotating couplings around the central hub assembly. In addition, though not illustrated, central hub assembly 52 is provided with conduits for delivering or receiving cooling water from upper truss 64 and lower truss 66.

Truss assembly 63 described above includes upper truss 64 which extends radially from the upper rotating coupling. One end of upper truss 64 is attached to the upper rotating coupling and the opposite end is attached to the inner circumference of support carriage 58. The second element of truss assembly 63 is lower truss 66 that extends radially and slightly upward from the lower rotating coupling toward a location where upper truss 64 is attached to the inner periphery of support carriage 58. One end of lower truss 66 is attached to the lower rotating coupling and the opposite end is attached to the inner periphery of support carriage 58 at a location just below the location where upper truss 64 is connected to support carriage 58. In order to reduce weight and provide conduits for carrying cooling water to and from support carriage 58, trusses 64 and 66 are preferably hollow tubes or pipes.

As noted above, central hub assembly 52, the upper rotating coupling, and the lower rotating coupling are provided with manifolds (not shown) to deliver cooling fluid to upper truss 64 and receive cooling fluid from lower truss 66. Upper truss 64 delivers the cooling fluid to upper section 98 in support carriage 58 and lower truss 66 transports cooling fluid away from lower section 100 in support carriage 58. In the illustrated embodiment, seven truss assemblies are illustrated; however, it should be understood that additional trusses or fewer trusses can be provided depending upon the load requirements for support carriage 58 and wheel hubs 30.

As described above, support carriage 58 defines a pathway through which metal alloy parts to be heat treated in accordance with the present invention are passed. These metal alloy parts are carried on the upper surface of support carriage 58 at spaced intervals. Referring to FIGS. 3 and 4, at each of the spaced intervals, support carriage 58 includes a bore 94 defining temperature sensing opening 68 that extends from the upper surface to the lower surface of support carriage 58. The size of temperature sensing opening 68 may vary; however, as described below in more detail, the size of opening 68 must be such that a noncontact optical sensor 90 located below carriage 58 can "see into", i.e., interrogate the inner surface 33 within the internal cavity 32 of wheel hub 30 being carried by carriage 58.

As best illustrated in FIG. 3, at each spaced interval, seated on the upper surface of support carriage 58 is a ring-shaped heat insulating barrier 70 made from a material having low thermal conductivity, such as cellular glass. Heat insulating barrier 70 provides a thermal break between wheel hub 30 and the upper surface of support carriage 58. Heat insulating barrier 70 can be sized to be coextensive with the upper surface of support carriage 58 or it may be sized so that it is less than coextensive with the upper surface.

Residing on the upper surface of heat insulating barrier 70 is hub holder 72. Hub holder 72 is machined from a material capable of surviving repeated thermal cycles and the high temperatures associated with the heat treatment, such as a ceramic. When solution heat treatment is involved, the ceramic material should be capable of withstanding temperatures up to about 1200° F. and temperature variations of up to about 800° F. Hub holder 72, like heat insulating barrier 70, can extend coextensively with the upper surface of support carriage 58 or it may be configured to only be present at each of the spaced intervals. Hub holder includes a bore defining temperature sensing opening 74 and heat insulating barrier 70 includes temperature sensing opening 76. Again, these openings are sized to permit optical sensor 90 to interrogate the inside surface 33 of hub 30 from below.

In order to ensure that wheel hubs 30 are properly positioned above temperature sensing opening 68, 74 and 76, hub holder 72 includes a circumferential rib 78 positioned and sized to cooperate with the hub to ensure that the opening in the hub is aligned with the temperature sensing openings in support carriage 58, heat insulating barrier 70 and hub holder 72. For alloy parts having shapes different than wheel hubs, rib 78 may not be appropriate and accordingly, an additional part holder can be configured to mate with these ribs on its lower surface, while its upper surface is shaped and configured to carry a part shaped differently than a wheel hub.

Rotating oven 50 includes hub loading area 80 that is preferably adjacent to a staging area for the just cast wheel hubs. At hub loading area 80, access to the upper surface of support carriage 58 is necessary, and accordingly, the support carriage is not associated with heat channel 82 at this location. As described above, the wheel hubs are loaded onto the hub holders 72 at the hub loading area 80. Preferably, the hubs 30 are loaded while support carriage 58 is advancing; however, hubs 30 can also be loaded when support carriage 58 is stationary.

From hub loading area 80, support carriage 58 advances wheel hubs 30 into rotary oven 50. As noted above, rotary oven 50 includes a plurality of infrared radiation sources 56. In the illustrated embodiment, rotary oven 50 includes 12 banks of infrared radiation sources 56 that each comprise 12 heating elements. The next 13 sources are divided into a group of seven and a group of six. The next seven are equipped with seven elements and the final group of six is equipped with three elements. Each of the 25 banks is individually controlled so that the amount of energy they apply to wheel hubs 30 can be modulated.

While the above control configuration is preferred, it should be understood that controlling a different number of the banks of infrared radiation sources is within the scope of the present invention.

Rotary oven 50 includes an inner heating channel 82 best seen in FIGS. 2 and 3. In the illustrated embodiment, inner heating channel 82 in vertical cross-section includes a flat floor 85 and a cover 87 in the shape of a partial ellipse. Heating channel 82 resembles a tunnel through which wheel hubs 30 are transported. Flat horizontal floor 85 of heating channel 82 includes an opening sized to permit hub holder 72 to pass through the floor into heating channel 82. In order to avoid excess loss of heat from heating channel 82, minimize the amount of infrared radiation that escapes heating channel 82, and isolate optical sensor 90 from direct and reflected infrared radiation, the size of the opening in floor 85 is sized so that the fit between hub holder 72 and the opening is closely toleranced. In the embodiment illustrated in FIG. 3, floor 85 is provided with inwardly extending flanges 83 which extend inwards and terminate at a point adjacent to the outer periphery of rib 78. Without such flanges, heat and radiation from within heating channel 82 would more readily escape through the gap between the outer periphery of hub holder 72 and the edge of floor 85. The inner periphery and outer periphery of heating channel 82 adjacent floor 85 extend upward vertically and then transition into an elliptical upper surface or roof 87. In the illustrated embodiment, positioned along the outer periphery of heating channel 82 is a bank of infrared radiation sources 56 comprising a plurality of individual infrared radiation elements 84. Individual infrared radiation elements 84 are positioned along the outer periphery and along the roof of heating channel 82 but are not positioned beyond the vertical center line of channel 82. By using aluminum as the heating channel material, reflection of infrared radiation from the individual infrared radiation elements 84 is achieved along those portions of heating channel 82 that are not occupied by elements 84, thus, the need for elements on the inner periphery of channel 82 is minimized. Though not illustrated, it should be understood that radiation elements could be positioned along the inner periphery of heating channel 82. When energized, individual infrared radiation elements 84 irradiate outer surface 31 of wheel hub 30 and provide the thermal energy to heat treat the hub. Conventional control systems controlled in accordance with the present invention are provided in order to adjust the radiant energy output from the individual infrared elements 84 as described below in more detail.

Heating channel 82 is housed within an aluminum housing 86 which has a cross-sectional shape similar to heating channel 82. Housing 86 is larger than channel 82 so that a plenum is defined between the outer surface of heating channel 82 and the inner surface of aluminum housing 86. A source of cooling air is provided to this plenum in order to facilitate cooling of the infrared radiation heat sources and to provide a protective thermal barrier. In the illustrated embodiment, unlike the upper surface of heating channel 82 which is substantially elliptical in shape, the upper surface of aluminum housing 86 comprises a partial decagon shape, which facilitates reflection of thermal energy back at the heating channel 82.

As described above, the initial 12 banks of infrared radiation sources 56 comprise 12 individual heating elements, the next seven banks include seven elements and the final six banks include three elements each. It should be understood that more infrared radiation banks having more or fewer individual elements can be employed depending upon the particular energy requirements for a given system. Also, other arrangements of the individual infrared radiators can be used.

Suitable sources of infrared radiation include a standard T-3 bulb and a novel source that includes a nichrome wire embedded in an alumina ceramic with only one-third of the coiled wire exposed. The embedding of the wire in the alumina ceramic adds additional support to the wire which otherwise upon energizing becomes hot and is susceptible to deformation under its own weight. This source of infrared energy provides temperatures on the order of 1,900–2,000° F. Such sources are available from Radiant Optics of Woodinville, Wash. Since such infrared radiation sources are typically lambertian radiators, and thus tend to radiate in all directions, it is presently preferred to use rectangular-shaped radiation sources, stacked on their sides to facilitate the direction of infrared radiation at the individual wheel hubs.

Support carriage 58 transports individual wheel hubs 30 along the pathway through heating channel 82. At the end of heating channel 82, a spring-loaded arm 88 extends from the central hub assembly 52 into the pathway of wheel hubs 30. As wheel hubs 30 come into contact with arm 88, they are forced from their position on hub holder 72 and onto a conveyor 89 which delivers the parts for further processing, such as quenching, then aging. This provides an unoccupied hub holder which then can be reloaded in the upcoming hub loading area 80.

In accordance with one feature of the present invention, temperature information for the wheel hubs being heat treated is collected from a surface that is remote from the surface that is being directly irradiated, and thus free from background temperature contributions from the radiation sources themselves and adjacent refractive structural elements, and also free from interfering radiation from the radiation sources and reflection from the treated part and other structural elements. By collecting temperature data from a surface other than the one being directly irradiated, an accurate reading of the temperature for the wheel hub at that surface can be obtained. As illustrated in the example, the difference in the temperature measurement obtained from an optical sensor directed at a surface being irradiated and an optical sensor directed to a surface remote from a surface being irradiated in accordance with the present invention provides very divergent measurements, particularly during the initial heat upstage when a large number of the infrared irradiation sources are active. With such large amounts of infrared energy being applied to the surface of the part, there is also a large amount of reflected infrared radiation present, both of which are detected by the optical sensors that are not isolated from these sources. This results in temperature measurements that can be significantly higher than the true temperature of the part at the measured surface. By relying upon temperature information for the wheel hubs collected from a surface that is remote from the surface that is being irradiated, and thus substantially free from the interfering background contributions from the infrared energy sources and reflection of infrared energy, one can accurately and reliably predict the progress of the heat treatment.

Referring to FIG. 3, an apparatus formed in accordance with the present invention includes a noncontact sensor 90 for collecting data representative of a temperature of wheel hub 30 measured at a location remote from the surface of the wheel hub that is directly exposed to the infrared radiation, e.g., surface 33. The heat treatment of the wheel hubs occurs along a thermal pathway beginning at the outer surface that is directly irradiated and ending at the inner surface. Preferably, the location/surface that is interrogated by the noncontact sensor is the end of the longest average thermal pathway. By sensing the temperature of the hub at the end of the longest average thermal pathway, one obtains a temperature reading that is more representative of the thermal treatment that the entire part has been exposed to. Unlike processes that measure the temperature at locations other than the end of the thermal pathway, e.g., at the surface being irradiated, the present invention allows one to reliably predict that the entire wheel hub has been heated to the temperature detected at the end of the longest average thermal pathway. The longest average thermal pathway is determined by identifying the thickest portions of the wheel hub that would appear to define the longest thermal conductance path through the part. Referring to FIG. 3, the longest average thermal pathway for the illustrated wheel hub would appear to be located at the upper one third of the wheel hub.

Above, it was noted that it was preferred that the parts be symmetrically shaped. The reason that symmetrically shaped parts are preferred is because of the ease of identifying the longest average thermal path way in a symmetrical part. When the part is not symmetrical, it becomes more difficult to identify the longest thermal conductance path. When dealing with parts that are not symmetrical, care must be taken to identify the thickest portion of the part that would appear to define the longest thermal conductance path for the part.

One type of suitable noncontact sensor is an infrared thermal broad band sensor such as an optical thermocouple. These types of thermocouples are available from Exergen Corporation of Watertown, Mass. Preferred sensors are those that have a sensitivity in the temperature range to be monitored. In the context of heat treatment of aluminum and aluminum alloys, an optical thermocouple having a sensitivity from room temperature to about 1,200° F. is suitable. In the illustrated embodiment, optical sensor 90 is positioned below support carriage 58 such that the optical sensor can interrogate cavity 32 within wheel hub 30 through the openings in the support carriage 58, hub holder 72 and heat insulating barrier 70. Optical sensor 90 is preferably positioned so that the measurement is taken at an angle in order to avoid direct reflection back from the wheel hub into the sensor. In addition, the sensor is preferably positioned so that sand or other material falling out of cavity 32 will not fall onto the thermocouple and damage it. Optical sensors 90 can be positioned at any location along the pathway of the wheel hubs in the heating channel. The sensors may be stationary relative to the support carriage, or they may be mounted so that they move with the support carriage. It should be understood that other non-contact techniques that allow one to detect a temperature of the wheel hubs at the preferred location are within the scope of the present invention.

Conventional computer control systems can be used to control sensors 90 and also to collect the temperature data as a function of time generated by sensors 90. As described in more detail below, the collected data can then be used to generate a thermal gradient profile for the treated hub and also to control the subsequent heat treatments of similar hubs by controlling the energy output from the respective infrared radiators in accordance with a control protocol described below in more detail. In addition to controlling the output from the infrared radiators, the computer may also control other variables, such as the speed that the parts are passed through the oven.

Another advantage of applicant's present invention as it pertains to measuring temperature at a location remote from the surface that is irradiated is that the surface which is interrogated by the optical sensor is preferably located in a black body source. By taking temperature measurements with an optical sensor from a black body source, the effects of background temperature contributions from the infrared radiation sources and reflection from the wheel hubs and surrounding refractive structures are avoided or minimized. In addition, a black body source within a wheel hub is a preferred measuring point because the black body source radiates energy that is directly proportional to the temperature of the hub independent of frequency. The detectable energy emanating from the black body source masks such factors as surface roughness, color, reflectivity and other properties that affect the emissivity of a surface, and thus the temperature of the surface as measured by an infrared sensor. Since it is contemplated that the heat treatment of multiple wheel hubs will be controlled based upon a given thermal gradient profile, it is important that the temperature measurements taken from a given wheel hub not be affected by variances in the emissivity of the surface of the wheel hub. Thus, by measuring the temperature of the wheel hub within a black body source, variances attributable to the emissivity of the surface can be minimized, and thus more reliable control of the heat treatment process can be obtained.

Referring to FIG. 3, for symmetrical parts such as wheel hubs that include a centrally located cavity within them, a cap 92 is provided to close off the top of the cavity and define a black body source within the hub.

For parts that are not symmetrical, a hub holder can be configured or provided with an adapter so that the part can be carried through the oven in a position that allows underlying optical sensor 90 to interrogate the part at a surface remote from the surface that is irradiated, preferably located within a black body source. This black body source can be a pre-existing cavity or it can be provided as with the wheel hub by capping an otherwise open cavity to provide a black body source.

Applicant has observed that the diffusion rate of the alloying elements is proportional to the rate at which the alloy is heated. In other words, the diffusion rate of the alloying elements is proportional to the change in temperature vs. the change in time. For wheel hubs of aluminum alloy 356, applicant has observed that in order to produce heat treated wheel hubs having satisfactory physical properties, a heating rate in the aluminum wheel hubs of at least 0.5° F. per second is preferred during the early stages of the solution heat treating operation. When the heating rate in the aluminum wheel hub, described in the example, is maintained at a level of at least 0.5° F. during the early stages of the solution heat treatment cycle, applicant has found that the solution heat treatment can be achieved in less than one hour. When the thermal gradient is less than 0.5° F. per second, suitable heat treatment can be achieved, but the time to complete the heat treatment will be longer. While applicant has not identified an upper limit to the 0.5° F. heating rate, if the rate is too high, thermal energy may be applied at a rate that exceeds the thermal dissipation rate of aluminum. If this happens, the casting may melt and will be lost. As the casting nears the upper limit, the rate must slow in order to avoid exceeding the melt temperature.

For parts of different sizes and different alloys, applicant's present invention provides a means for generating a temperature vs. time profile that can be used to control subsequent heat treatment of similar parts. It should be understood that in a broad sense, the present invention is not limited to the particular 0.5° F. per second heating rate threshold described above. It is contemplated that other thermal gradient thresholds will fall within the scope of the present invention.

When implementing a heat treatment process in accordance with the present invention, such as using the apparatus described above, a temperature vs. time profile for an aluminum alloy wheel hub can be developed, as described below, and as described in more detail in the following Example.

Figure 5:
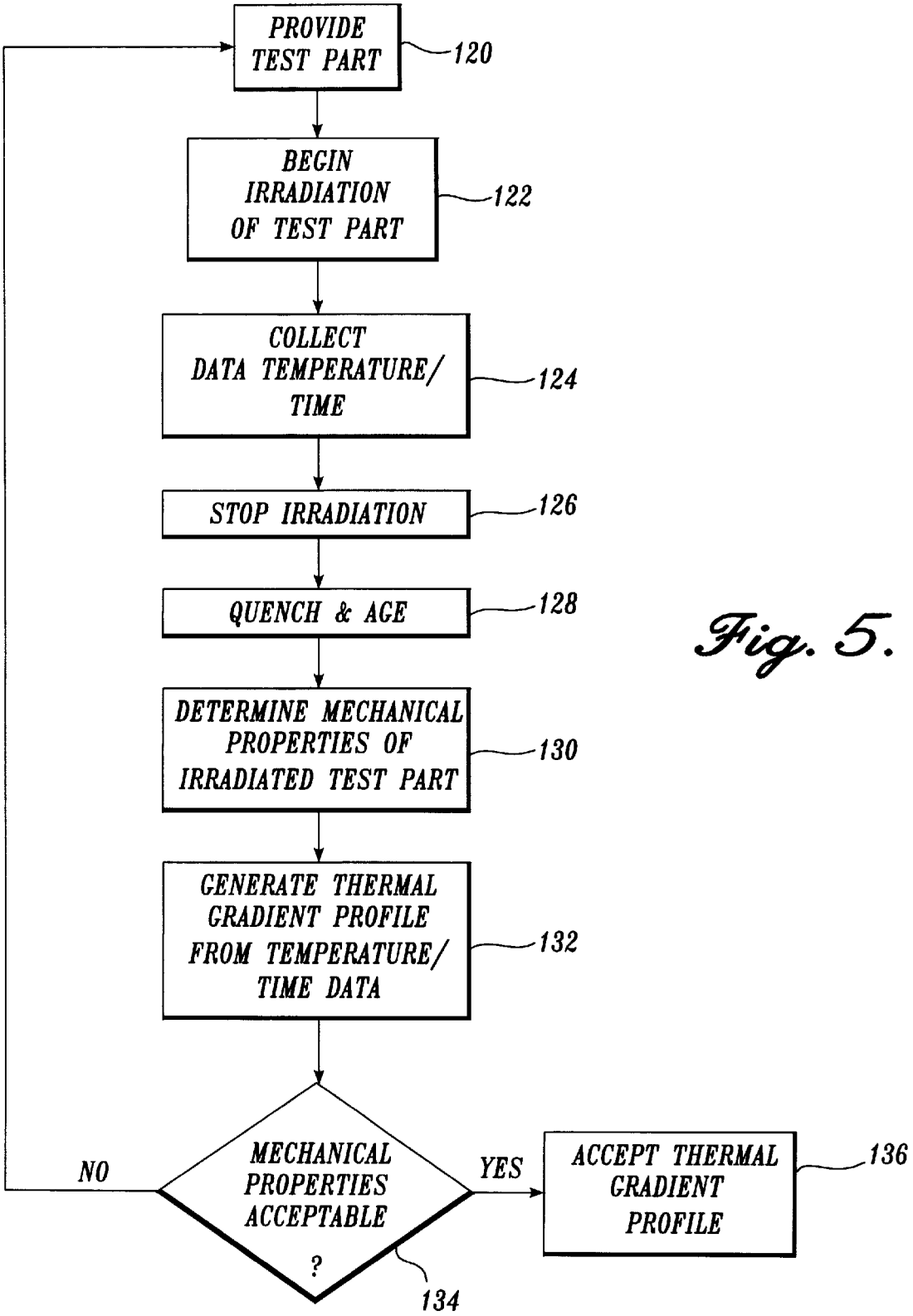
FIG. 5 is a flowchart for an embodiment of modeling a heat treatment of a metal alloy carried out in accordance with the present invention.

Referring to FIG. 5, a test hub of the particular alloy to be treated is provided at step 120. Within the test hub, a black body source is identified and defined using cap 92 as described above so that an optical sensor 90 can interrogate the black body source to collect data representative of a temperature of the hub at surface 33. Infrared radiation is applied to the test part at step 122 using the above-described infrared radiation energy sources. Care must be taken not to heat the part too vigorously in order to avoid melting the hub. On the other hand, the part should be heated as rapidly as feasible in order to minimize the overall process time. As the surface of the test part is irradiated, temperature data is collected from within the black body source at step 124. The collected data is recorded as a function of time to provide a thermal gradient profile and retained for further analysis. The irradiation should be continued until a target temperature is reached. The target temperature should be chosen within the range conventionally accepted as being a suitable solution heat treatment temperature range. After the irradiation step is complete at step 126, the part is quenched rapidly and then naturally or artificially aged according to conventional practice at step 128. Following aging, the mechanical properties of the test part were evaluated in step 130. Such properties include tensile strength, sheer strength, elongation, and hardness and are measured using conventional techniques. The thermal gradient profile is generated in step 132 and can then be evaluated for acceptability based on the results of the mechanical properties evaluation in step 134. If the mechanical properties of the treated hub are satisfactory, the profile of the thermal gradient developed from the collected data can be chosen in step 136 as a profile for the subsequent treatment of similar parts. If the mechanical properties were not satisfactory, the profile of the thermal gradient developed from the collected data can be discarded and the sequence repeated and changes made in the heating profile until satisfactory mechanical properties are identified.

Once a suitable thermal gradient profile is identified, it can be used to control a process for heat treating multiple metal alloy parts that are similar to the test part in shape, size and composition. The following description of a control process carried out in accordance with the present invention for heat treating metal alloy parts is provided with reference to the apparatus described above. It should be understood that this aspect of the present invention is not limited to the apparatus described herein. Practice of the process described below with other apparatuses for heat treating a metal alloy part is considered to be within the scope of the present invention. The following description of the control process assumes that the cast part has been analyzed to determine a geometric center as well as to define a black body source within the part for direct measurement of temperature at a surface remote from the surface to which the infrared radiation is applied.

Figure 6:
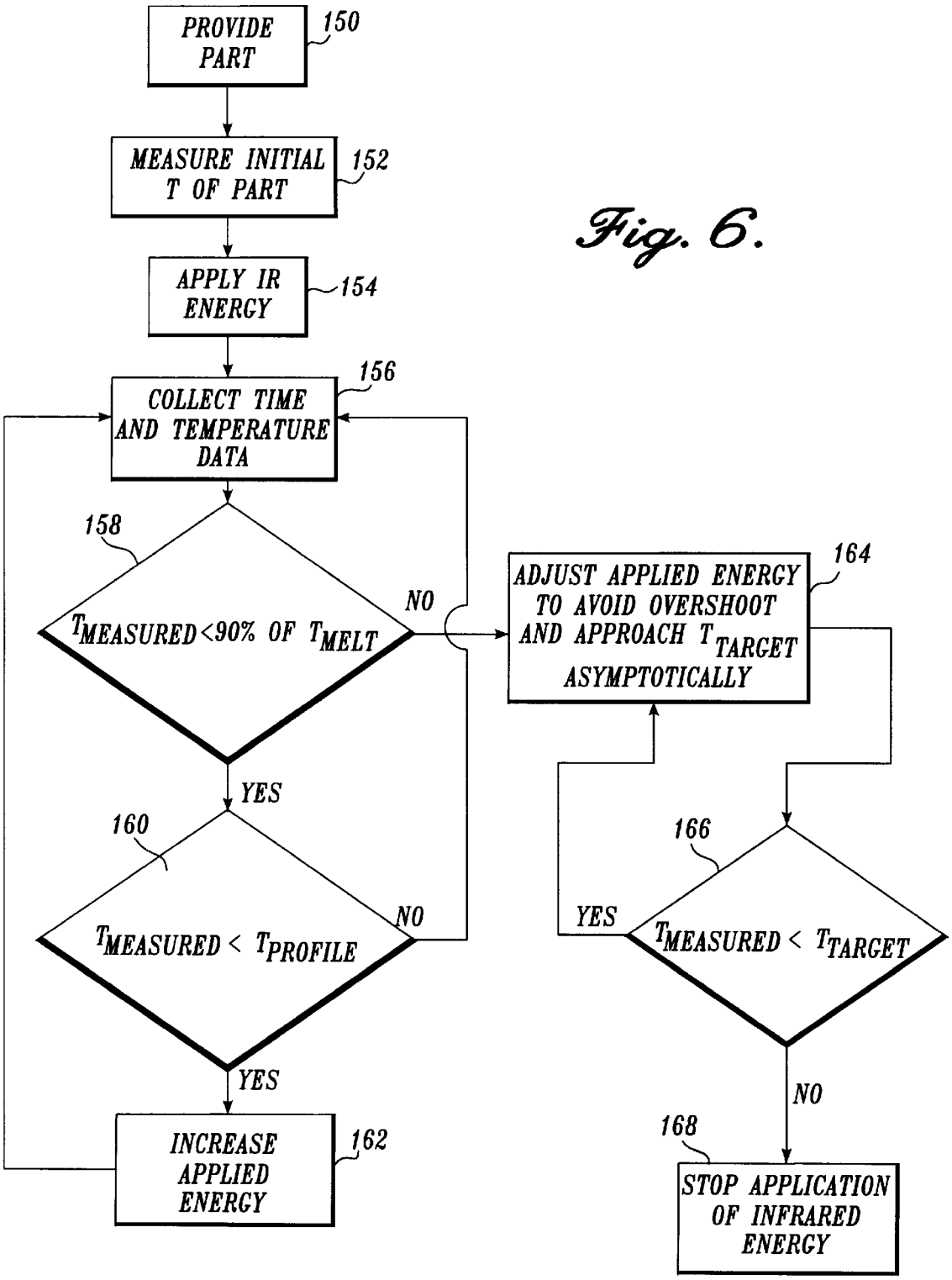
FIG. 6 is a flowchart of an embodiment of a method for controlling a heat treatment of a metal alloy carried out in accordance with the present invention.

In accordance with this aspect of the present invention, an aluminum alloy wheel hub is provided at the loading station of the radiant oven described above. Referring to the flow chart in FIG. 6, after providing a part at step 150, the initial temperature of the part is measured at step 152 using the optical thermocouple to observe the temperature in the black body source. After the initial temperature is measured, it is recorded and used to set the initial intensity of the radiation sources. When the system is a linear, in-line (serial) process, parts do not have to wait for a "batch." Parts can be put into the oven "hot" from casting. The initial temperature measurement puts the part on the schedule for additional thermal energy. Generally, the greater the differential between the initial temperature of the wheel hub and the target temperature, the greater the initial intensity of the irradiation. Infrared energy is applied to the outer surface of the wheel hub at step 154. The initial intensity at which the infrared radiant energy is applied to the wheel hub is preferably selected so that the thermal gradient in the black body source is at least 0.5° per second. In order to assure accurate temperature data and the generation of an accurate thermal gradient profile, it is preferred to sample the temperature at one second intervals or less at step 156. Active control of the intensity of infrared energy applied to the wheel hub is achieved in step 158 by comparing the temperature measured from the black body source ($T_{MEASURED}$) with a threshold temperature set point equal to 90% of the melt temperature for the alloy, ($T_{MELT}$) If $T_{MEASURED}$ is less than 90% of $T_{MELT}$, $T_{MEASURED}$ is compared to the thermal gradient profile and the particular point in time along the gradient. If $T_{MEASURED}$ is less than the thermal gradient profile temperature $T_{PROFILE}$, the control system may increase the intensity of the applied radiant energy at step 162. The sequence of collecting the time and temperature data then repeats itself beginning with step 156.

If $T_{MEASURED}$ is not less than $T_{PROFILE}$, the intensity of the applied radiant energy is not changed and steps 156 and 158 are repeated so that $T_{MEASURED}$ is measured again and compared to $T_{MELT}$.

If $T_{MEASURED}$ is not less than $T_{MELT}$, the control system controls the intensity of the applied radiant energy so that $T_{MEASURED}$ does not overshoot $T_{MELT}$ and yet approaches the target temperature, $T_{TARGET}$ asymptotically. $T_{TARGET}$ is preset to be the temperature of surface 33 where complete solution heat treatment is achieved. Because of the excellent control afforded this temperature monitoring technique, $T_{TARGET}$ can be set between 97% and 98% of the melt temperature, thus, assuring that a solutionizing temperature is achieved. The goal in this step is to ensure that the thermal momentum of the part is not so great that the temperature of the part will rise to a point where the part melts. Thus, the goal in step 164 is to approach $T_{TARGET}$ asymptotically while ensuring that the part stays comfortably away from $T_{MELT}$. In step 166, $T_{MEASURED}$ is compared to $T_{TARGET}$. If $T_{MEASURED}$ is less than $T_{TARGET}$, the control system adjusts the radiant energy applied to the wheel hub. $T_{MEASURED}$ is again measured and compared to $T_{TARGET}$ until such point that $T_{MEASURED}$ is no longer less than $T_{TARGET}$ at which time the application of infrared energy is stopped at step 168. While it is preferable to remove the part from the heating sequence as soon as the part reaches $T_{TARGET}$, it should be understood that the part can be maintained at $T_{TARGET}$ for a period of time if required based on the location of the part in the oven.

As discussed above, when $T_{MEASURED}$ is no longer less than 90% of $T_{MELT}$, the intensity of infrared radiation applied to the wheel hub must be scaled back so that the thermal momentum of the part does not cause the temperature of the part to exceed $T_{MELT}$ for any extended period of time. Scaling back of the infrared energy can be achieved by shutting down some of the radiant energy sources and/or modulating the power to others. The goal is to slow the temperature rise rate exponentially such that $T_{TARGET}$ is approached asymptotically. When viewing the first derivative of the thermal gradient profile, the asymptotical approach to $T_{TARGET}$ is indicated by the first derivative approaching zero.

In this system, the accurate measure of the temperature, the measure of time, and proportional control of the infrared radiant sources allow the management of the process over dissimilar castings. For instance, if the temperature of a casting is taken at the beginning of the process and the output of the radiant sources is set at some nominal level, and then if the temperature is taken again after the passage of a measured amount of time, the effect of the radiant energy can be calculated (e.g., degrees per watt of applied energy).

If this number is compared to the ideal profile, a prediction can be made for the result of the next increment of time given a new radiant output setting. In other words, given the performance of the oven system over the first measured increment, a correction factor can be calculated for the next increment. If the profile indicated that the casting should have achieved a temperature rise of 50° F., but it only reached a temperature rise of 40° F., then a first approximation would be that over the second increment the energy should be turned up by a factor 120% plus 20% of the energy from the first increment that was not delivered. If the second segment delivers 120% of the planned energy and the missing 20% of the energy for segment one is also added, the temperature over the second segment should achieve that required to meet the profile.

When the temperature is measured at the end of segment number two, the same calculation will be made. If the increments are close enough together and the control is accurate enough, then the control system should stay close enough to the profile to guarantee the same effective solutionizing process.

In other words, if a new casting is inserted into the oven and the temperature is measured, then if the temperature is measured again after a measured amount of time with the radiant sources set at a certain level, a correction can be made if the temperature rise per unit of time is compared to the intended profile. If the degrees per unit time is low (either the casting is bigger or the emissivity is lower than expected) the power can be raised a calculated amount based on the assumption that within small temperature ranges the thermal conductivity, infrared efficiency and emissivity are linear and only the size of the casting has varied.

EXAMPLE

The following example illustrates the advantages achieved by monitoring the temperature of an aluminum alloy part being subjected to a solution heat treatment using infrared energy sources in accordance with the present invention.

An aluminum 356 cast wheel hub similar to the one illustrated in FIG. 3 was solution heat treated using the system described below.

A small furnace was used to solution heat treat the hub. The furnace comprised 20 radiant energy sources comprising a novel source featuring a nichrome wire embedded in an alumina ceramic with only one-third of the total wire exposed. Each source was a 1500 watt unit and was assigned a number from 1–20. These sources were in the shape of rectangular bricks having a width of approximately 2 inches and a height of approximately 12 inches. The sources were arranged so that their long axes were vertical and were placed side by side in a circular configuration. An aluminum sheath was provided around the outside of these heating elements in temperatures up to about 1900° to 2000° F. The sources were obtained from Radiant Optics of Woodinville, Wash. These elements were set upon a round heat resistant base that included an opening in its middle. The furnace was centered on the base and the opening provided access to the interior of the furnace. The furnace was open on its top but was provided with a conical aluminum cap in order to minimize convective influences.

The furnace was provided with two noncontact infrared optical thermocouples. The first optical thermocouple, Sensor A, was embedded in the side of the furnace and directed at the outer surface of the wheel hub within the furnace. The infrared energy source in which Sensor A was embedded was deactivated to avoid damaging the sensor. Thus, Sensor A was capable of detecting a temperature of the wheel hub at a surface that was irradiated. Sensor A was an Exergen Model IRt/c.3X available from Exergen Corporation of Watertown, Mass.

The second noncontact infrared optical thermocouple, Sensor B an Exergen Model IRt/c.10A, was provided below the furnace and base and aimed into the furnace through the opening in the base. As described above, the wheel hub with its open interior cavity and flat bottom surface rested on and was centered over the opening in the heat resistant base. The opening in the base permits Sensor B to interrogate the inner surface of the hub. The base and wheel hub serve to isolate Sensor B from background temperature contributions, from direct radiation from the radiation sources, and also isolate it from reflection from the hub or other surfaces. The top of the internal cavity in the hub was closed off by a suitable cap, thus defining a black body source within the wheel hub.

Sensor A was provided with air and water cooling sheaths in order to cool the sensor. Sensor B was provided with cooling air only. Both Sensors A and B were connected to a computer for collection of temperature and time data in a conventional manner.

The individual infrared energy sources were coupled to a conventional switch contactor and power router box which provided a means for controlling the amount of radiant energy applied to the hub. The power router box included manual switches which allowed the user to manually activate or deactivate a given infrared energy source.

As described above, the wheel hub with its open interior cavity was centered over the opening in the base of the furnace. Conventional contact thermocouples were embedded in the bottom of the wheel hub and in the middle of the body of the wheel hub. Both of these thermocouples were also connected to the computer in order to collect time and temperature data.

The initial heating cycle was begun by using all of the available nineteen infrared heating units.

The activation of the infrared energy sources was continued until the middle thermocouple indicated that the temperature of the hub was about 500° F. At this time, alternating (even numbered) radiation sources were deactivated. The temperature of the hub as measured by middle thermocouple was then monitored until 900° F. was reached. At this time, all of the radiation sources except for units 1, 7, 11 and 15 were deactivated. Sources 1, 7, 11 and 15 were controlled so that they were activated 90 percent of every 10-second interval until the temperature as measured by the middle thermocouple approached 950° F. At this point, the rate of application of radiant energy was reduced by activating sources 1, 7, 11, and 15 only 5 seconds out of each 10-second cycle. The purpose of this modulation was to raise the hub temperature as measured by the middle thermocouple to 1010° F. over approximately 30 minutes allowing solutionizing to continue. When the middle thermocouple measured a temperature of 1000° F., sources 1, 7, 11 and 15 were throttled back to be activated for only 3 seconds during every 10-second interval. The purpose of this modulation was to reduce the rate that the temperature of the hub measured by the middle thermocouple approached the melt temperature of the aluminum alloy. Thirty minutes after the middle thermocouple indicated a temperature of 950° F., the temperature measured by the middle thermocouple was 1110° F. The hub was then removed from the furnace and placed into a water bath in order to quench it. The total elapse time into the test was 55 minutes.

Figure 7:
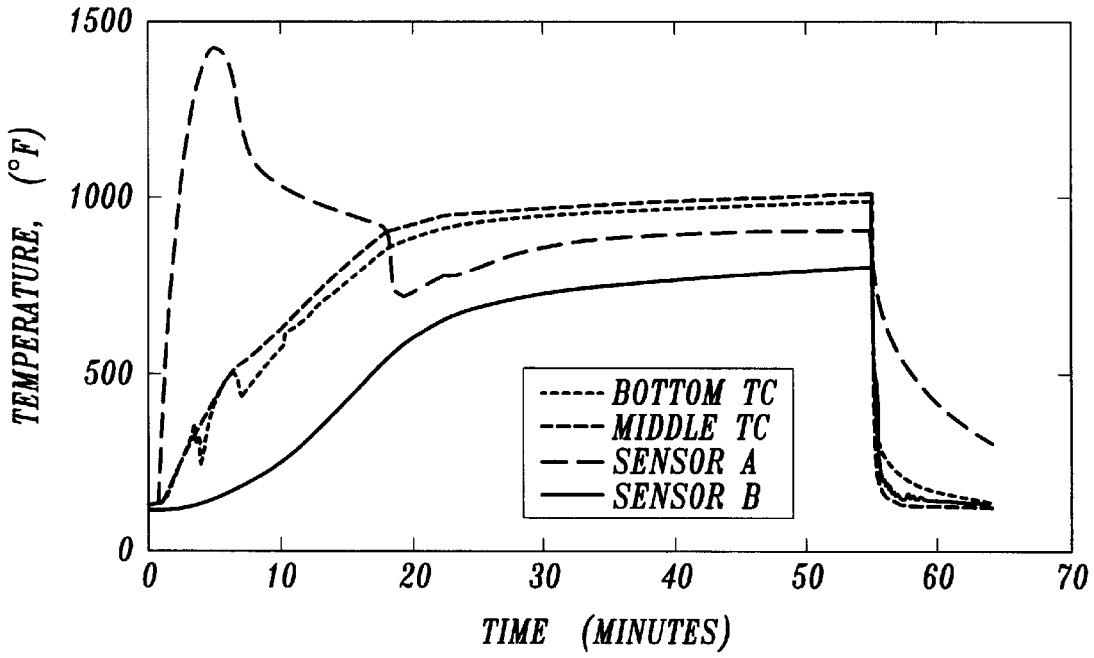
FIG. 7 is a graph of time versus temperature for a cast aluminum part treated in accordance with the present invention.

FIG. 7 represents the time versus temperature data collected from the various thermocouples.

FIG. 7 shows that Sensor A which was measuring a surface of the wheel hub that was directly irradiated by the radiation sources provides a reading which is greatly at odds with the readings obtained from the two thermocouples embedded in the hub as well as Sensor B interrogating the black body source in accordance with the present invention. This is particularly evident in the early heat-up stages of the solution heat treatment process. In contrast, Sensor B provides temperature data that more accurately reflects the true temperature profile or thermal gradient of the hub as reflected by the middle and bottom thermocouple. In this Example, Sensor B was not calibrated, and thus provided thermal data that was offset from the true temperature of the measured surface. In practice, Sensor B should be calibrated so as to provide in absolute terms an accurate reading of the temperature of the measured surface.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of controlling a heat treatment of a metal alloy part using infrared radiation as an energy source comprising the steps:

providing a test part of the metal alloy, the test part being compositionally and geometrically representative of a part of the metal alloy to be subsequently heat treated;

applying thermal energy to the test part by irradiating a surface of the test part with infrared radiation;

collecting data representative of a temperature of the test part as a function of time at a test location remote from the surface that is irradiated;

determining mechanical properties of the test part after completion of the irradiating step;

generating a thermal gradient profile from the collected data;

accepting or rejecting the thermal gradient profile based on the mechanical properties of the test part after completion of the irradiation step;

providing the part of the metal alloy;

applying thermal energy to the part by irradiating a surface of the part with infrared radiation;

collecting data representative of a temperature of the part as a function of time at a part location remote from the surface that is irradiated, the part location being spatially related to the part in substantially the same way that the test location is related to the test part; and adjusting the amount of thermal energy applied to the part during the applying step in response to a comparison between the data collected for the part and the thermal gradient profile.

2. The method of claim 1, wherein the test location and the part location define an endpoint for a longest average thermal path for the test part and part respectively.

3. The method of claim 1, wherein the test location and the part location are a black body source within the test part and part respectively.

* * * * *